United States Patent [19]

Love

[11] Patent Number: 4,646,716

[45] Date of Patent: Mar. 3, 1987

[54] ANDIRON MOUNTING SYSTEM

[76] Inventor: Samuel D. Love, 13510 Old Indian Head Rd., Brandywine, Md. 20613

[21] Appl. No.: 781,715

[22] Filed: Sep. 30, 1985

[51] Int. Cl.[4] ..... F24B 13/00

[52] U.S. Cl. ..... 126/298; 126/165; 403/391; 403/399

[58] Field of Search ..... 126/164, 152 R, 152 A, 126/152 B, 165, 201, 202, 298, 336; 403/182–184, 296, 391, 399, 393; 248/225.31, 231; D23/138.2, 138.3, 138.4

[56] References Cited

U.S. PATENT DOCUMENTS

| | | | |
|---|---|---|---|
| 1,503,421 | 7/1924 | Innes | 301/99 |
| 2,461,256 | 2/1949 | Black | 303/31 |
| 4,166,447 | 9/1979 | Creim | 126/298 |
| 4,211,734 | 7/1980 | Cheng | 261/39 B |
| 4,257,392 | 3/1981 | Bettenbaugh | 126/164 |
| 4,288,055 | 9/1981 | Gump | 248/231.14 |
| 4,450,827 | 5/1984 | Love | 126/298 |

FOREIGN PATENT DOCUMENTS 0320995 6/1935 Italy .

*Primary Examiner*—James C. Yeung
*Attorney, Agent, or Firm*—Parkhurst & Oliff

[57] ABSTRACT

An andiron mounting system for directly and swivelably connecting an andiron to a fireplace grate is provided. An elongate connecting member attaches the andiron to the fireplace grate. An adjustable mounting bracket connects the elongate connecting member to the andiron so that the andiron can be attached to fireplace grates of different heights. An attachment means secures the other end of the elongate connecting member to the fireplace grate. The attachment means includes two movable sides so the andiron can be mounted on different types of fireplace grates. The attachment means is swivelably connected to the elongate connecting member so that the andirons can be freely and easily moved.

39 Claims, 12 Drawing Figures

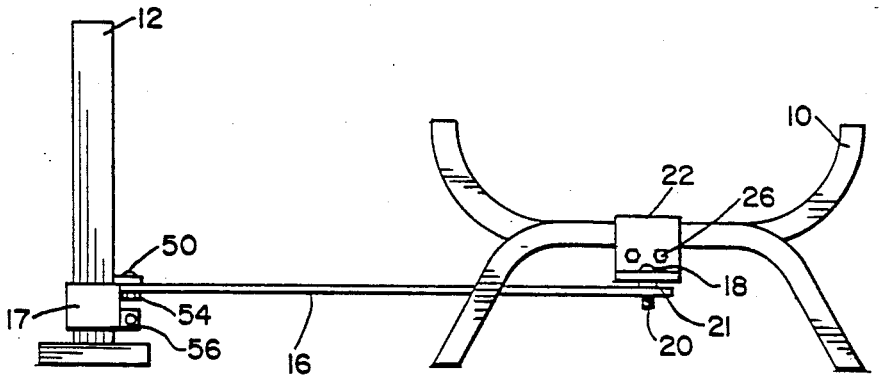
Fig. 8
Fig. 11
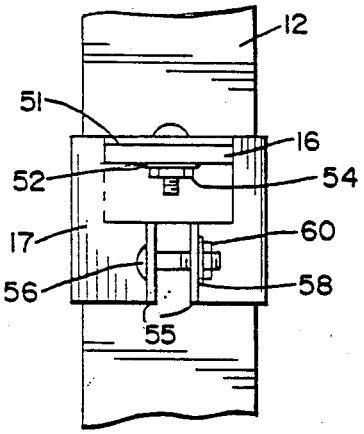
Fig. 10
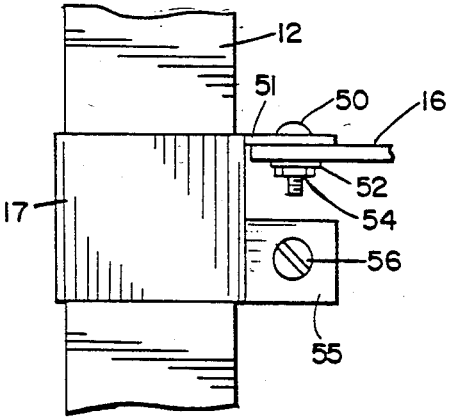
Fig. 9
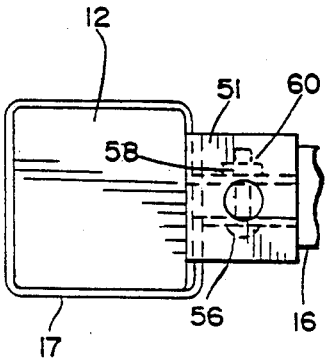
Fig. 12
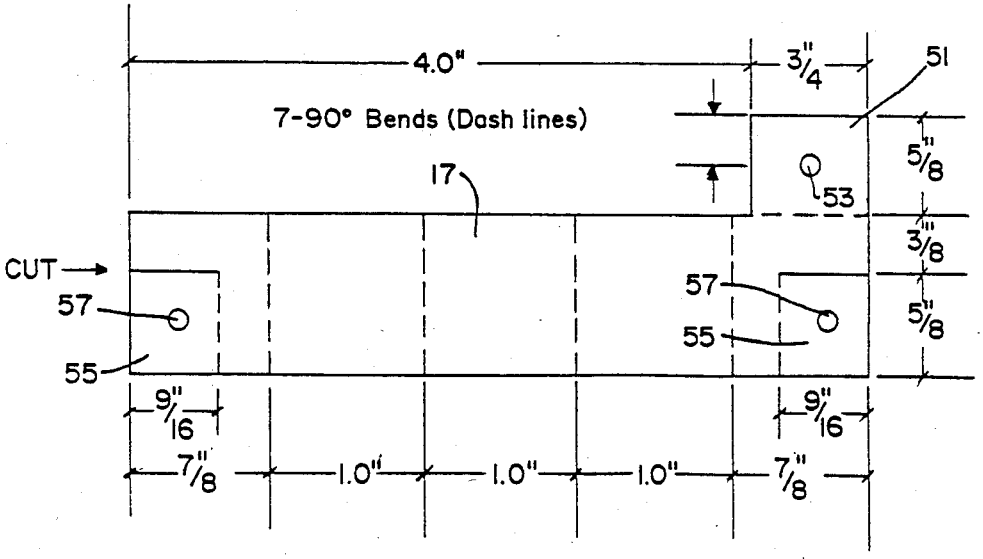

ANDIRON MOUNTING SYSTEM

BACKGROUND OF THE INVENTION

1. Field of the Invention

This invention relates to a device for attaching an andiron directly to a fireplace grate, and more particularly, to a device for swivelably mounting an andiron to various types and sizes of fireplace grates.

2. Description of the Prior Art

In the past, andirons have been situated in a fireplace and supported by legs which extend underneath the fireplace grate. As a result, the andirons have been difficult to move for refueling or cleaning the fireplace grate. The legs of the andirons have also cluttered the area beneath the grate, making it difficult to use a draft control or other device in the fireplace and making cleaning of the hearth area difficult.

U.S. Pat. No. 4,450,827 discloses a system for attaching andirons directly to a fireplace grate. However, the mounting system disclosed in that invention is limited in its applications. It is best used on cast iron fireplace grates and others which are constructed with bars which are square in cross-section. Steel fireplace grates, which generally have bars which are diamond-shaped in cross-section, require a different mounting system. Furthermore, since the prior art relies on clamping two bars of the fireplace grate between flat plates, the system cannot be used on fireplace grates whose bars are set further apart than the length of the clamping plates. Still further, the prior art mounting system comes in direct contact with the combustible materials on the grate, which reduces the life of the mounting unit.

Prior art mounting systems were also limited in how they were secured to the andirons. The members for connecting the andirons to the fireplace grate were welded to the andirons. The connecting members were therefore of a specific height which could not easily be adjusted. Thus, it was difficult to attach the andirons to fireplace grates of varying heights.

SUMMARY OF THE INVENTION

It is an object of this invention to provide a mounting system for andirons whereby the andirons are mounted directly to a fireplace grate.

It is a further object of this invention to provide an andiron mounting system wherein the andirons may be placed any desired distance from the fireplace grate.

It is still a further object of this invention to provide an andiron mounting system wherein the andirons may be pivoted or swiveled so as to provide clear and easy access to the fireplace grate.

It is a still further object of this invention to provide an andiron mounting system which is easily adjustable in height and can be mounted on fireplace grates of any height.

It is a still further object of this invention to provide an andiron mounting system which is easily adaptable to currently existing fireplace grates, whether their bars are square or diamond-shaped in cross-section, and which is clamped directly to a single bar of the fireplace grate.

It is still a further object of this invention to provide an andiron mounting system which does not come in contact with the combustible materials on the grate, thus prolonging its life.

It is a still further object of this invention to provide an andiron mounting system which is of simple and economical manufacture, constructed in such a manner that replacement parts are simple in design and readily obtainable.

The above objects and others are achieved by providing an andiron mounting system wherein a connecting member, which is attached to the andiron, is directly mounted to the fireplace grate using an attachment member. The connecting member is mounted by a stud which extends through an aperture in the connecting member, and continues through an aperture in the base of an attachment member. In one embodiment the attachment member includes an "L"-shaped member of an "I"-shaped member joined by two adjustable bolts. A third adjustable bolt stabilizes the attachment member at the base. The attachment member grips one bar of the fireplace grate by adjusting the bolts to move the "L" shaped member in relation to the "I"-shaped member. Thus, this attachment member can be used on bars of any cross-sectional shape. In a second embodiment, a single "U"-shaped clamp is mounted on the connecting member. The sides of the "U" shaped clamp are moved in relation to each other using two adjustable bolts.

At its opposite end, the connecting member is fastened to a mounting bracket which clips onto and the andiron and can be secured by tightening a nut and bolt assembly. Loosening the nut and bolt assembly permits the mounting bracket to slide up and down on the andiron to any desired height. Thus, the andiron mounting system can be adjusted for use with a fireplace grate of any height.

BRIEF DESCRIPTION OF THE DRAWINGS

The above objects, features and advantages of the present invention will become apparent from the description of the invention which follows, taken in conjunction with the accompanying drawings, wherein like reference numerals denote like elements, and wherein:

FIG. 8 is a cross-sectional view of the fireplace, andiron and andiron mounting system along the line II—II of FIG. 7;

FIG. 9 is a top view of the mounting bracket according to the present invention for mounting the andiron mounting system on an andiron;

FIG. 10 is a side view of the bracket of FIG. 9;

FIG. 11 is a front view of the bracket of FIG. 9; and

FIG. 12 is a top view of a piece of sheet metal before it is cut and bent to form the bracket of FIG. 9.

The present invention will be described in detail with reference to the accompanying drawings which illustrate a preferred embodiment according to the present invention.

DESCRIPTION OF A PREFERRED EMBODIMENT

Figure 1:
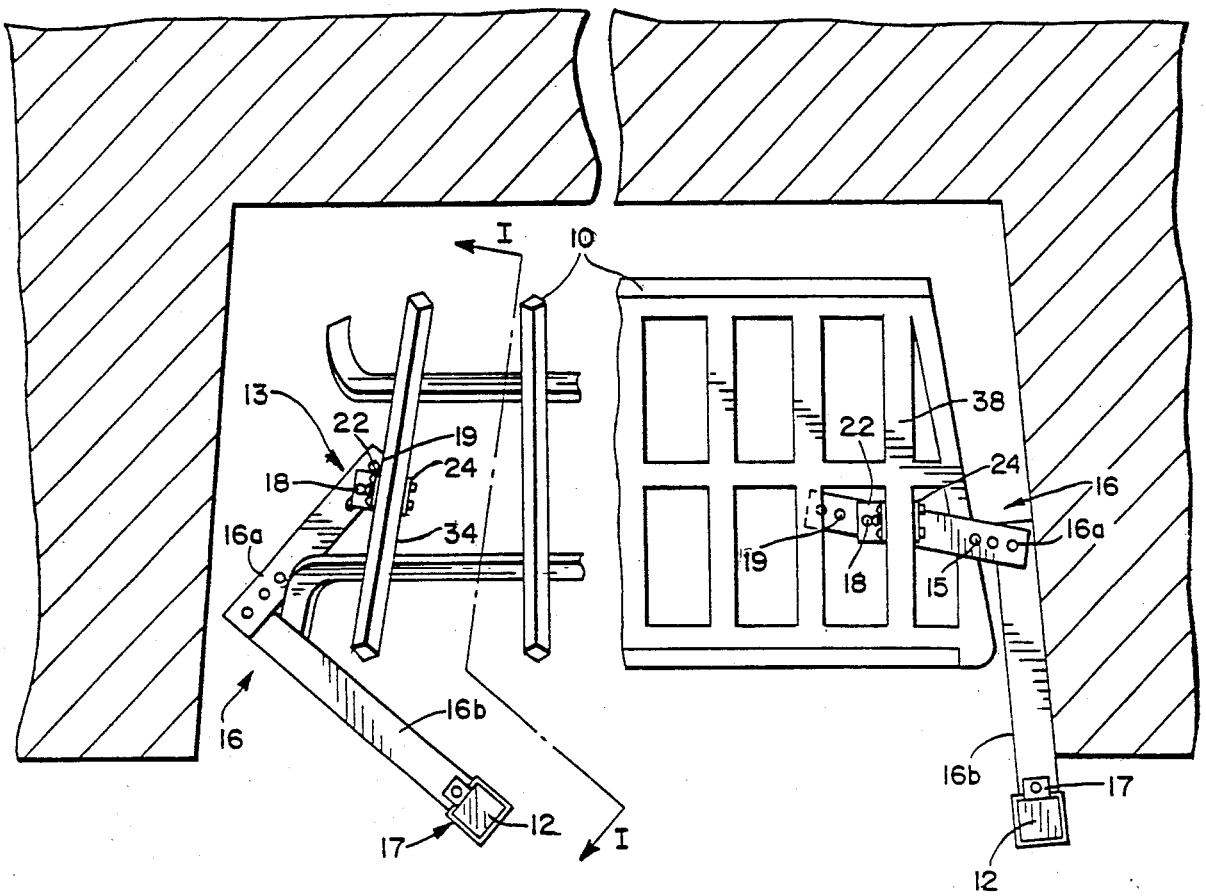
FIG. 1 is a top view of a fireplace grate with the andiron mounting system of the present invention.

Referring to FIG. 1, there is shown a fireplace grate 10, andirons 12, connecting member 16 and attachment system 13 for attaching the connecting member 15 to the grate 10. The connecting member 16 is secured to the andiron 12 by means of a mounting bracket 17. The attachment system 13 is attached to connecting member 16 by a stud 18.

Figure 2:
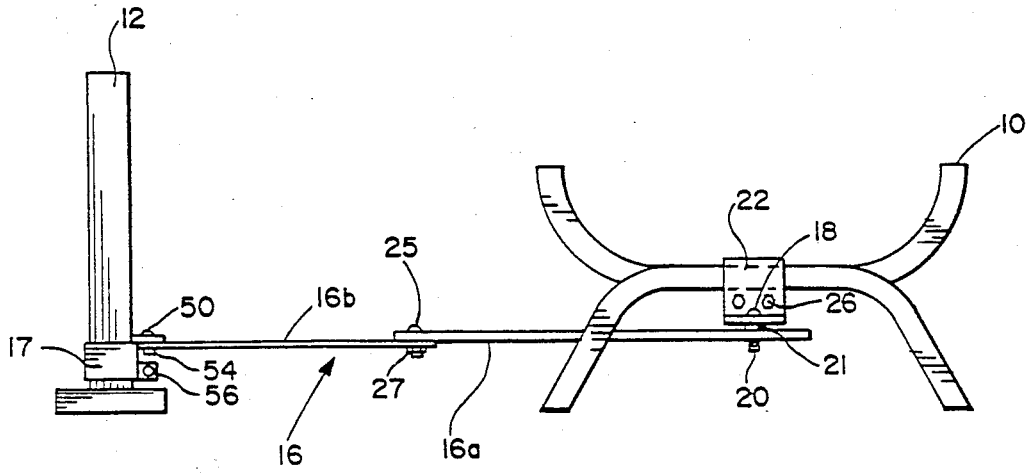
FIG. 2 is a cross sectional view of the fireplace, andiron and andiron mounting system of the present invention taken along line I—I of FIG. 1.

In the embodiment of FIGS. 1 and 2, connecting member 16 includes two elongate connecting members, 16*a* and 16*b*. Elongate connecting member 16*a* is swivably attached to fireplace grate bars such as 34 or 38, while elongate connecting member 16*b* is connected to andiron 12 by means of mounting bracket 17.

Elongate connecting member 16*a* is preferably provided with a plurality of connecting holes 19 for stud 18. The plurality of holes 19 for stud 18 allows variations in the point of connection between elongate connecting member 16*a* and the attachment system 13. Elongate connecting member 16*a* is also preferably provided with a plurality of holes 15 where member 16*b* is attached. This allows variations in the final position of andiron 12. Alternatively, a plurality of holes could also be provided in part 16*b*.

Parts 16*a* and 16*b* are tightly bolted together using bolt 25 and nut 27 as shown in FIG. 2. Thus, when part 16*a* abuts the back of the grate leg 11, the andiron cannot be moved outwardly, for example by a falling log. Preferably, both parts 16*a* and 16*b* abut the grate leg. Part 16*b* should be adjusted to the proper position before it is completely secured to part 16*a*.

In the left side of FIG. 1 connecting member 16 is shown with andiron 12 in position in front of fireplace grate 10. In this position the fireplace 15 is ready for use. It is best that connecting member 16 abut grate leg 11 to provide additional support, however, a plurality of positions are possible.

In the right side of FIG. 1 connecting member 16 is shown in position for cleaning and refueling the fireplace. Here, connecting member 16 abuts the wall of the fireplace. This braces fireplace grate 10, holding it in position so it does not move while the area beneath it is cleared, logs are placed on it, or logs are removed.

In FIGS. 1 and 2, mounting bracket 17 mounts connecting member 16 on andiron 12 at any desired horizontal position. Referring to FIGS. 9–12, mounting bracket 17 comprises a piece of sheet metal (shown in FIG. 12) bent to form a hollow tube (shown in FIGS. 9–11). The sheet metal is cut and bent to form the tube and three flanges. Top flange 51 projects horizontally, perpendicular to the central axis of the tube. The two lateral flanges 55 project vertically and are parallel to each other and perpendicular to flange 51.

Since one side of mounting bracket 17 is not closed, it can be sprung open, and either snapped around a square column such as andiron 12, or if there is not a bend at the top of andiron 12 slipped over the top. FIG. 12 shows the dimensions of a mounting bracket 17 designed to fit around a one inch square steel tube, which is the standard size for andirons 12. However, this bracket design can be redimensioned to fit any size andiron. Furthermore, the bracket 17 of FIG. 12 can be used on andirons 12 slightly larger or smaller than one inch.

Top flange 51, of mounting bracket 17 projects outwardly from mounting bracket 17 and andiron 12. Connecting member 16 is positioned below top flange 51, and connected to it by bolt 50 which passes through an aperture 53 on flange 51 and is fastened by washer 52 and nut 54.

To allow mounting bracket 17 to be secured at any desired horizontal position along the shaft of andiron 12, bolt 56 passes through aperture 57 on one of lateral flanges 55, continues through the aperture 57 in the second lateral flange 55 and is secured by washer 58 and nut 60. When tightened, mounting bracket 17 will be compressed and tightly secured to andiron 12 and will not slip. This type of bracket 17 ensures that the present invention can be used with any fireplace grate 10, regardless of its height from the floor of the fireplace.

Figure 3:
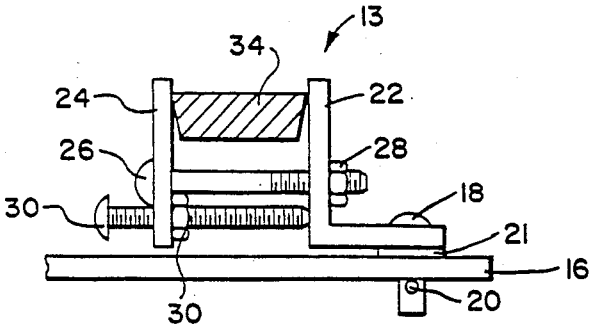
FIG. 3 is an enlarged cross sectional view of one embodiment of an attachment member of the andiron mounting system used to attach the mounting system to the fireplace grate.
Figure 4:
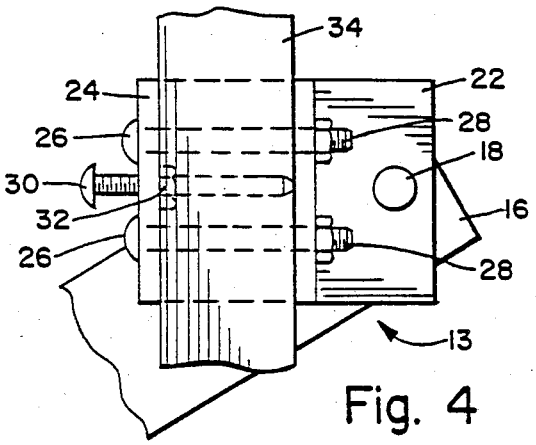
FIG. 4 is a top view of the attachment member of FIG. 3.

Referring to FIGS. 2–4, connecting member 16 is attached to the grate 10 by means of the attachment system 13. In one embodiment stud 18 extends through an aperture provided in the base of "L"-shaped member. A washer 21 is provided between clamp jaw 22 and connecting member 16. Stud 18 further extends through one of a series of apertures 19 provided in connecting member 16.

Stud 18 is secured by means of cotter pin 20, which is readily removed and replaced if mounting system 13 is to be adjusted by being connected through one of the other apertures 19 provided in connecting member 16. "L"-shaped member 22 is connected to "I"-shaped member 24 by means of two adjustable bolts 26 which pass through apertures provided in "I"-shaped member 24 and then continue through apertures in "L"-shaped member 22 where they are held in place or adjusted by nuts 28.

Any one of grate bars 34 can be attached to the mounting system 13 by placing one of grate bars 34 between member 22 and 24 tightening bolts 26.

In order to stabilize members 22 and 24 and keep them essentially parallel, stabilizing bolt 30 passes through a stabilizing aperture provided in "I"-shaped member 24 until it meets the vertical face of the "L"-shaped 26. Stabilizing bolt 30 is then adjusted by tightening stabilizing nut 32.

Stud 18 is provided with a smooth bearing surface to allow the attachment system 13 and connecting member 16 to be swivelably rotated. this allows for easy access to the fireplace grate. Also, mounting system 13 can be attached to any of the bars 34 or 38 provided on the fireplace grate. This allows the user great latitude in the positioning of the andirons. Furthermore, the mounting system 13 may be attached at any point along the length of one of the bars, allowing the andirons to be positioned at any desired distance from the front of the fireplace grate. Since the need for rear legs of the andiron support is obivated by the present invention, the space underneath the fireplace grate is relatively clear, thus allowing for easier cleaning of the fireplace hearth or for placement of a device such as a draft control device.

Figure 5:
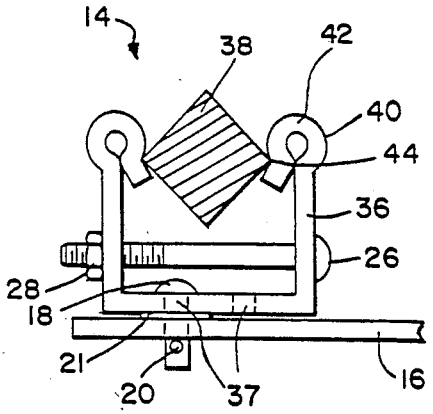
FIG. 5 is a cross sectional view of an alternate embodiment of the attachment member.
Figure 6:
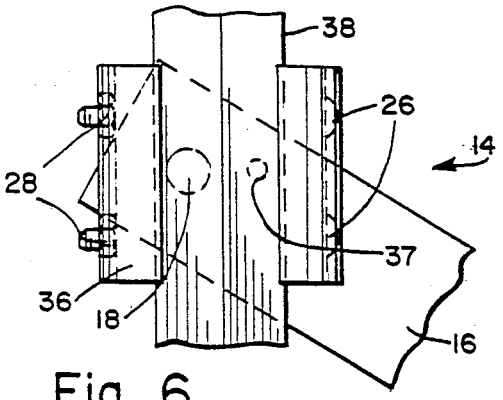
FIG. 6 is a top view of the mounting bracket of FIG. 5.

In an alternate embodiment as shown in FIGS. 5 and 6, attachment system 14 includes a single "U"-shaped clamp 36. Clamp 36 is joined to connecting member 16 by a stud 18 passing through either of two apertures 37 in the base of clamp 36, one or more washers 21, and an aperture in connecting member 16. Stud 18 is secured by cotter pin 20. Provision of two apertures 37 in the base of clamp 36 gives additional flexibility of increasing the maximum possible distance between fireplace grate 10 and andiron 12. "U"-shaped clamp 36 is adjusted by tightening nuts 28 on bolts 26, which pass through apertures on the two opposite vertical sides of clamp 36. The upper ends of verticle sides of clamp 36 form a hook 40 by making a bend of greater than 180° towards the inside of the "U" and are then bent slightly in the opposite direction to leave small "V"-shaped indentations 44 in the ends of the hook 40. Two diagonally opposing corners of grate bar 38, which is diamond-shaped in cross-section, are gripped by the "V"-shaped indentations 44 in the ends of the clamp 36. Tightening of nuts 28 will force the ends of the hooks on clamp 36 toward the outer, vertical edges of clamp 36, thereby securing grate bar 38 in the clamp. Although FIGS. 5 and 6 show a diamond-shaped grate bar 38, this "U"-shaped configuration can also be used with square grate bars 34, or bars of the other cross-sectional shape. Furthermore, in this embodiment, only mounting system 14 is different; all other aspects of the invention remain as described in the first embodiment.

Figure 7:
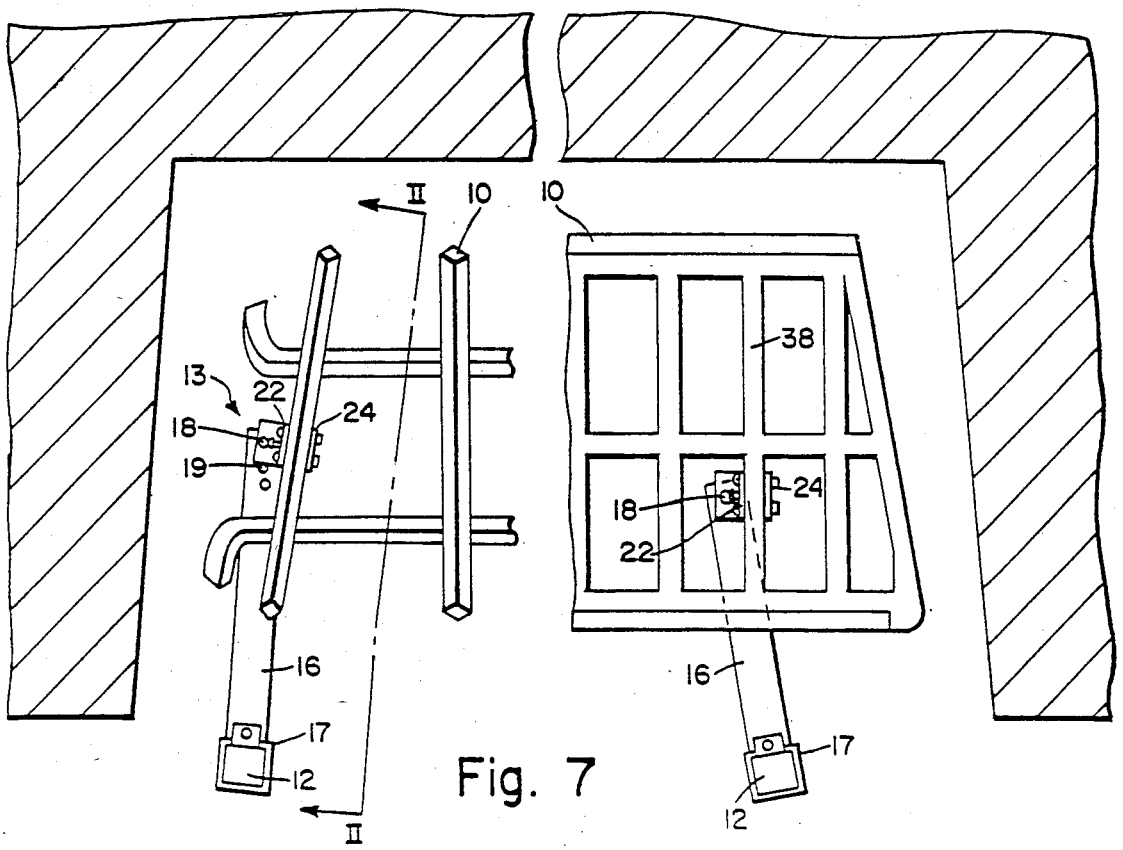
FIG. 7 is a top view of an alternative embodiment of a fireplace grate with an andiron mounting system of the present invention.

In the alternative embodiment of FIGS. 7 and 8, connecting member 16 is comprised of a single part. This requires connecting member 16 to pass between grate legs 11, instead of around them as in FIG. 1. This limits the arc in which andirons 12 can be moved.

This alternative embodiment relies on the same mounting bracket 17, which joins connecting member 16 to andiron 12, as the preferred embodiment. It also uses either of the two attachment systems 13 or 14 described in the preferred embodiment.

While the present invention has been described in its preferred embodiments, it is to be understood that the invention is not limited thereto, and may be otherwise embodied within the scope of the following claims:

What is claimed is:

1. An andiron mounting system comprising:

an elongate connecting member including a first end and a second end, said second end being attachable to an andiron;

an attachment member for securing said first end of said connecting member to a fireplace grate, said attachment member comprising an "L"-shaped member including a vertical portion and a base portion, said "L"-shaped member containing at least one aperture in said base portion; and connecting means for securing said attachment member to said elongate connecting member and for allowing said elongate connecting member to swivel in relation to said fireplace grate, said connecting means comprising a stud extending vertically through one of a plurality of vertical apertures in said elongate connecting member and through said at least one aperture in said base portion, said stud having a smooth bearing surface.

2. The andiron mounting system of claim 1, wherein the connecting means further comprises a washer disposed immediately above said vertical aperture in said elongate connecting member, said stud passing through said washer.

3. The andiron mounting system of claim 2, wherein said connecting means further comprises a cotter pin, said stud being secured by said cotter pin at a point below a point at which said stud emerges from said at least one aperture in said elongate connecting member.

4. The andiron mounting system of claim 1, further comprising an "I"-shaped member, said "L"-shaped member being joined to said "I"-shaped member by two adjustable bolts passing through a second aperture and a third aperture in said vertical portion of said "L"-shaped member and through a corresponding fourth aperture and fifth aperture in said "I"-shaped member, said bolts being secured by nuts, said nuts adapted to be tightened to move said "L"-shaped member and said "I"-shaped member together.

5. The andiron mounting system of claim 4, further comprising a stabilizing bolt adapted to pass through a stabilizing aperture below said corresponding fourth and fifth apertures insaid "I"-shaped member until an end of said stabilizing bolt contacts said "L"-shaped member, and a stabilizing nut adapted to be positioned on said third bolt and tightened against an inner face of said "I"-shaped member.

6. An andiron mounting system comprising:

an elongated connecting member including a first end and a second end, said second end being attachable to an andiron;

an attachment member for securing said first end of said connecting member to a fireplace grate, said attachment member comprising a "U"-shaped clamp for gripping said fireplace grate, said "U"-shaped clamp containing at least one aperture; and connecting means for securing said attachment member to said elongated connecting member and for allowing said elongated connecting member to swivel in relation to said fireplace grate, said connecting means comprising a, stud extending vertically through one of a plurality of vertical apertures in said elongate connecting member and through said at least one aperture in said "U"-shaped clamp, said stud having a smooth bearing surface.

7. The andiron mounting system of claim 6, wherein said "U"-shaped clamp includes two vertical sides each of which includes an upper portion, each of said upper portions of said vertical sides including a first bend, said first bend being toward an inside of said "U"-shaped clamp, said first bend being at least 180°.

8. The andiron mounting system of claim 7, wherein each of said upper portions of said "U"-shaped clamp includes a second bend, each of said first bends and said second bends cooperating so as to form a "V"-shaped indentation.

9. The andiron mounting system of claim 8, wherein each of said vertical sides of said "U"-shaped clamp includes apertures, said andiron mounting system further including bolts, said bolts adapted to pass through said apertures and adapted to move said verticle sides.

10. An andiron mounting system comprising:

an elongate connecting member including a first end and a second end, said first end being adapted for attachment to a fireplace grate;

an adjustable mounting bracket for attaching said second end of said elongate connecting member to an andiron, said mounting bracket being adjustable in relation to said andiron so that said connecting member is at the proper height for connection to said fireplace grate, said adjustable mounting bracket comprising:

a piece of sheet metal formed into a short hollow tube having at least two sides, said short hollow tube being dimensioned to fit over said outer surface of said andiron, said short hollow tube comprising a main body of said mounting bracket; and an upper flange which is bent outward perpendicularly and horizontally to the longitudinal direction of said main body of said mounting bracket, said upper flange further comprising an aperture which is adapted to pass a bolt therethrough, said bolt adapted to further extend through an aperture in said elongate connecting member, said bolt being secured by a nut.

11. The andiron mounting system of claim 10, wherein said mounting bracket further comprises two lateral flanges, said two lateral flanges projecting vertically from the main body of said bracket, each of said two lateral flanges further comprising apertures adapted to pass a bolt therethrough, said bolt adapted to be secured by a nut at one end, said nut and bolt adapted to move said lateral flanges together, said movement of said lateral flanges functioning to draw said at least two sides of said main body of said mounting bracket together.

12. The andiron mounting system of claim 10, wherein said elongate connecting member comprises a single essentially straight piece including at least one aperture at each of said first end and said second end.

13. The andiron mounting system of claim 10, wherein said elongate connecting member comprises two essentially straight bars.

14. The andiron mounting system of claim 13, further comprising a means for adjusting the length of at least one of said two essentially straight bars.

15. The andiron mounting system of claim 13, further comprising a means for non-movably connecting said first bar to said second bar.

16. The andiron mounting system of claim 13, wherein said first bar is an elongate member including a plurality of apertures.

17. An andiron mounting system as claimed in claim 13, wherein said second bar is an elongate member containing a plurality of apertures.

18. An andiron mounting system, comprising:

an andiron;

an elongate connecting member for connecting said andiron to a fireplace grate, said elongate connecting member including a first end and a second end;

a mounting bracket for connecting said second end of said connecting member to said andiron at any of a plurality of positions on said andiron;

an attachment member for securing said first end of said connecting member to a fireplace grate at any one of a plurality of positions on said grate, said attachment member comprising an "L"-shaped member including a vertical portion and a base portion, said base portion including an aperture extending therethrough; and connecting means for allowing said elongate connecting member to swivel in relation to said fireplace grate, said connecting means comprising a stud extending vertically through one of a plurality of vertical apertures in said elongate connecting member and through said aperture in said base portion, said stud having a smooth bearing surface permitting said elongate connecting member to swivel, said stud being secured by a cotter pin at a point below a point at which said stud emerges from said aperture in said elongate connecting member.

19. The andiron mounting system of claim 18, wherein said first end of said connecting member is supported vertically by said grate at a point different from points at which the grate is itself supported vertically.

20. The andiron mounting system of claim 18, wherein said elongate connecting member comprises a first bar and a second bar, a first end of said first bar being said second end of said elongate connecting member and being attached to said mounting bracket, and a first end of said second bar being said first end of said elongate connecting member and being connected to said attachment member.

21. The andiron mounting system of claim 20, wherein a means is provided for adjusting the length of at least one of said first bar and said second bar.

22. The andiron mounting system of claim 20, further comprising a means for non-movably connecting said first bar at a second end thereof to said second bar at a second end thereof.

23. The andiron mounting system of claim 20, wherein said first bar is a second elongate member provided with a plurality of apertures at said first end and said second end thereof.

24. The andiron mounting system of claim 20, wherein said second bar is a third elongate member provided with a plurality of vertically extending apertures at said second end thereof.

25. The andiron mounting system of claim 18, wherein said elongate connecting member comprises a single essentially straight piece comprising a first end and a second end, at least one of said first end and said second end including apertures suitable for attachment to an andiron and a fireplace grate.

26. The andiron mounting system of claim 18, further comprising a washer disposed immediately above said one of a plurality of vertical apertures in said elongate connecting member through which said stud extends.

27. The andiron mounting system of claim 18, further comprising an "I"-shaped member, said "L"-shaped member being joined to said "I"-shaped member by two adjustable bolts passing through a second aperture and a third aperture in said verticle portion of said "L"-shaped member and a corresponding fourth aperture and fifth aperture in said "I"-shaped member, said bolts adapted to be secured by nuts, said nuts adapted to be tightened to move said "L"-shaped member and said "I"-shaped member.

28. The andiron mounting system of claim 27, further comprising a stabilizing bolt passing through a stabilizing aperture below said fourth and fifth apertures of said "I"-shaped member until an end of said stabilizing bolt contacts said "L"-shaped member, whereupon a nut on said third bolt is tightened against an inner face of said "I"-shaped clamp jaw.

29. The andiron mounting system of claim 18, wherein said mounting bracket comprises a piece of sheet metal formed into a short hollow tube having at least two sides, said short hollow tube being dimensioned to fit over said outer surface of said andiron, said short hollow tube comprising a main body of said mounting bracket.

30. The andiron mounting system of claim 29, wherein said mounting bracket further comprises an upper flange which is bent outward perpendicularly and horizontally to the longitudinal direction of the main body of said mounting bracket, said upper flange further comprising an aperture which is adapted to pass a bolt therethrough, said bolt adapted to further extend through an aperture in said elongate connecting member, said bolt adapted to be secured by a nut.

31. The andiron mounting system of claim 30, wherein said mounting bracket further comprises two lateral flanges, said two lateral flanges projecting vertically from the main body of said bracket, each of said two lateral flanges further comprising apertures adapted to pass a bolt therethrough, said bolt adapted to be secured by a nut at one end, said nut and bolt adapted to move said lateral flanges together, said movement of said lateral flanges functioning to draw said at least two sides of said main body of said mounting bracket together.

32. An andiron mounting system, comprising:

an andiron;

an elongated connecting member for connecting said andiron to a fireplace grate, said elongate connecting member including a first end and a second end;

a mounting bracket connecting said second end of said connecting member to said andiron at any of a plurality of positions of said andiron;

an attachment member for securing said first end of said connecting member to a fireplace grate at any one of a plurality of positions on said grate, said attachment member comprising a "U"-shaped clamp for gripping said fireplace grate, said "U"-shaped clamp including a plurality of apertures extending therethrough, said stud extending through one of said plurality of apertures in said elongate connecting member and one of said plurality of apertures in said U-shaped clamp, said stud being secured by a cotter pin at a point below a point at which said stud emerges from said one of a plurality of vertical apertures in said elongate connecting member.

33. The andiron mounting system of claim 32, wherein said "U"-shaped clamp includes two vertical sides, each of said two vertical sides including an end portion, each of said two end portions including a first bend, said first bends being toward an inside of said "U"-shaped clamp, said first bends being at least 180°.

34. The andiron mounting system of claim 33, wherein each of said end portions of said "U"-shaped clamp includes a second bend, said first and second bends cooperating so as to form a "V"-shaped indentation.

35. The andiron mounting system of claim 34, further comprising apertures in said vertical sides, said andiron mounting system further including bolts, said bolts adapted to pass through said apertures in said vertical sides and adapted to move said verticle sides.

36. An andiron mounting system comprising:

at least one elongate connecting member comprising a first end and a second end, said first end of said elongate connecting member including at least one aperture;

an adjustable mounting bracket for attaching said second end of said at least one elongate connecting member to an andiron, said adjustable mounting bracket comprising a tube of essentially rectangular cross section, said mounting bracket further comprising an upper flange which extends perpendicularly to a longitudinal direction of said tube, said upper flange being adapted to be connected to said second end of said at least one elongate connecting member, said mounting bracket further comprising two lateral flanges extending from said tube, each of said two lateral flanges including an aperture, said apertures positioned so as to pass a first bolt therethrough, whereby when a first nut positioned on said first bolt is tightened said tube will compress in size; and an attachment member for securing said first end of said elongate connecting member to a fireplace grate, said attachment member including a first side and a second side, each of said first side and said second side including at least one aperture adapted to pass a second bolt therethrough, whereby when a second nut positioned on said second bolt is tightened said second side and said first side are caused to move together.

37. The andiron mounting system of claim 36, wherein said first and second side of said attachment member are verticle portions of a "U"-shaped clamp and wherein each of said verticle portions includes an upper end, each of said upper ends of said verticle portions including a first bend, said first bend being toward an inside of said "U"-shaped clamp and being greater than 180°, each of said uper ends of said verticle portions further including a second bend in a direction opposite to the direction of said first bend, said first bends and said second bends cooperating so as to form "V"-shaped indentations.

38. The andiron mounting system of claim 36, wherein said first side of said attachment member comprises an "L"-shaped bracket including a horizontal base portion and a vertical portion, said horizontal base portion extending parallel to said at least one elongate connecting member and including an aperture therethrough, said aperture in said verticle base portion cooperating with said at least one aperture in said first end of said elongate connecting member to pass a third bolt therethrough, and wherein said second side of said attachment member comprises an "I"-shaped bracket, wherein said at least one aperture in said first side and said second side is two apertures in each of said first side and said second side whereby a fourth bolt and a fifth bolt connect said first "L"-shaped side to said second "I"-shaped side.

39. The andiron mounting system of claim 38, wherein said "I"-shaped member further comprises a stabilizing aperture, said stabilizing aperture adapted to pass a stabilizing bolt therethrough, said stabilizing bolt adapted to be attached to a nut, an end of said stabilizing bolt adapted to contact an inner face of said verticle portion of said "I"-shaped member.

* * * * *